US005863108A

United States Patent [19]

Lederer

[11] Patent Number: 5,863,108

[45] Date of Patent: Jan. 26, 1999

[54] ELECTRONIC CANDLE WITH APPEARANCE SIMULATION

[76] Inventor: Gabor Lederer, 28 Summit Ave., Hackensack, N.J. 07601

[21] Appl. No.: 82,774

[22] Filed: May 21, 1998

[51] Int. Cl.[6] ..... F21L 7/00

[52] U.S. Cl. ..... 362/186; 362/202; 362/392; 362/806

[58] Field of Search ..... 362/186, 202, 362/806, 392, 293, 190

[56] References Cited

U.S. PATENT DOCUMENTS

| | | | |
|---|---|---|---|
| 2,483,820 | 10/1949 | Falge | 362/189 |
| 4,210,953 | 7/1980 | Stone | 362/189 |
| 4,642,391 | 2/1987 | Gappelberg | 362/186 |
| 4,819,140 | 4/1989 | Griffin | 362/189 |

*Primary Examiner*—Thomas M. Sember
*Attorney, Agent, or Firm*—Graham & James LLP

[57] ABSTRACT

Generally the present invention comprises a decorative holder for an electrically powered candle emulation device comprising an outer, substantially transparent/translucent hollow cylindrical member. The holder further comprises a second member comprising a flexible cylindrical segment of an etched plastic material with a longitudinal slit along its entire length. The outer circumference of the cylindrical segment is slightly larger than the inside circumference of the outer cylindrical member and is of a dimension whereby it can be radially compressed to fit into the outer cylindrical member into juxtaposition with the inner walls for the fixed positioning of the second member within the first member. The holder further comprises a third member comprising a transparent colored film of essentially the same outer dimensional area of the second member. The third film colored member is positioned between the first and second members in order to provide decorative coloring to the cylindrical holder. The third member is provided with a longitudinal slit similar to that of the second member for permitting the placement thereof in a wrap around fashion on the second member. Appropriate candle emulation electronics are placed into the holder to provide the effect of a wax candle contained within an etched and colored decorative holder.

2 Claims, 1 Drawing Sheet

ELECTRONIC CANDLE WITH APPEARANCE SIMULATION

FIELD OF THE INVENTION

This invention relates to electric candles which emulate the lighting and appearance of flame candles such as wax votive candles and particularly relates to the appearance of votive candles in decorative cylindrical glass holders.

BACKGROUND OF THE INVENTION

Wax candles with open flames are often used for various decorative and religious purposes. A common use is that of votive candles which are arranged in tiers and rows on special stands, in churches. However, candles alone, if used in quantity or without visual supervision, can pose hazard risks of conflagration. Accordingly, the votive candles are often enclosed within cylindrical decorative holders such as partially transparent or translucent colored glasses, in cup form, for the peripheral protection thereof and for the providing of an aesthetic lighted appearance. The colored glasses are available in a large variety of etched appearances and colors. Recently, the wax candles used with actual flames have been giving way to lower heat and safer electrical light emulations of candles within plastic containers. However in order to fully emulate the decorative nature of the colored and etched glasses used with the wax votive candles it is necessary to maintain large stockpiles of varying plastic containers of different etchings and colors.

SUMMARY OF THE INVENTION

It is accordingly an object of the present invention to provide a cylindrical decorative holder of a transparent plastic material with retaining elements molded therein for the placement of separate decorative etched elements and colored film elements.

It is a further object of the present invention to provide the decorative holder, decorative etched elements and colored film elements as separate elements of varying combinations and permutations to simulate a full gamut of prior decorative votive candle holders, without need for excessive storage or stockpiles.

Generally the present invention comprises a decorative holder for an electrically powered candle emulation device such as used in place of wax votive candles. The holder comprises an outer, substantially transparent/translucent hollow cylindrical member, preferably with integrally formed, inwardly circularly disposed holding means such as circular indentations.

The holder further comprises a second member comprising a flexible cylindrical segment of an etched plastic material with a longitudinal slit along its entire length. The outer circumference of the cylindrical segment is slightly larger than the inside circumference of the outer cylindrical member and is of a dimension whereby it can be radially compressed to fit into the outer cylindrical member into juxtaposition with the inner walls and holding means thereof for the fixed positioning of the second member within the first member. The second member may be unitary or a single element or it may comprise several elements which are adapted for fitment within various portions of the first member.

The holder further comprises a third member comprising a transparent colored film of essentially the same outer dimensional area of the second member. The third film colored member is positioned between the first and second members in order to provide decorative coloring to the cylindrical holder. The third member is provided with a longitudinal slit similar to that of the second member for permitting the placement thereof in a wrap around fashion on the second member.

Appropriate candle emulation electronics are placed into the holder to provide the effect of a wax candle contained within an etched and colored decorative holder.

BRIEF DESCRIPTION OF THE DRAWINGS

The above and other objects, features and advantages of the present invention will become more evident from the following discussion and drawings in which the sole FIGURE isometrically depicts an exploded view of the decorative holder of the present invention.

DETAILED DESCRIPTION OF THE DRAWINGS AND PREFERRED EMBODIMENT

Figure 1:
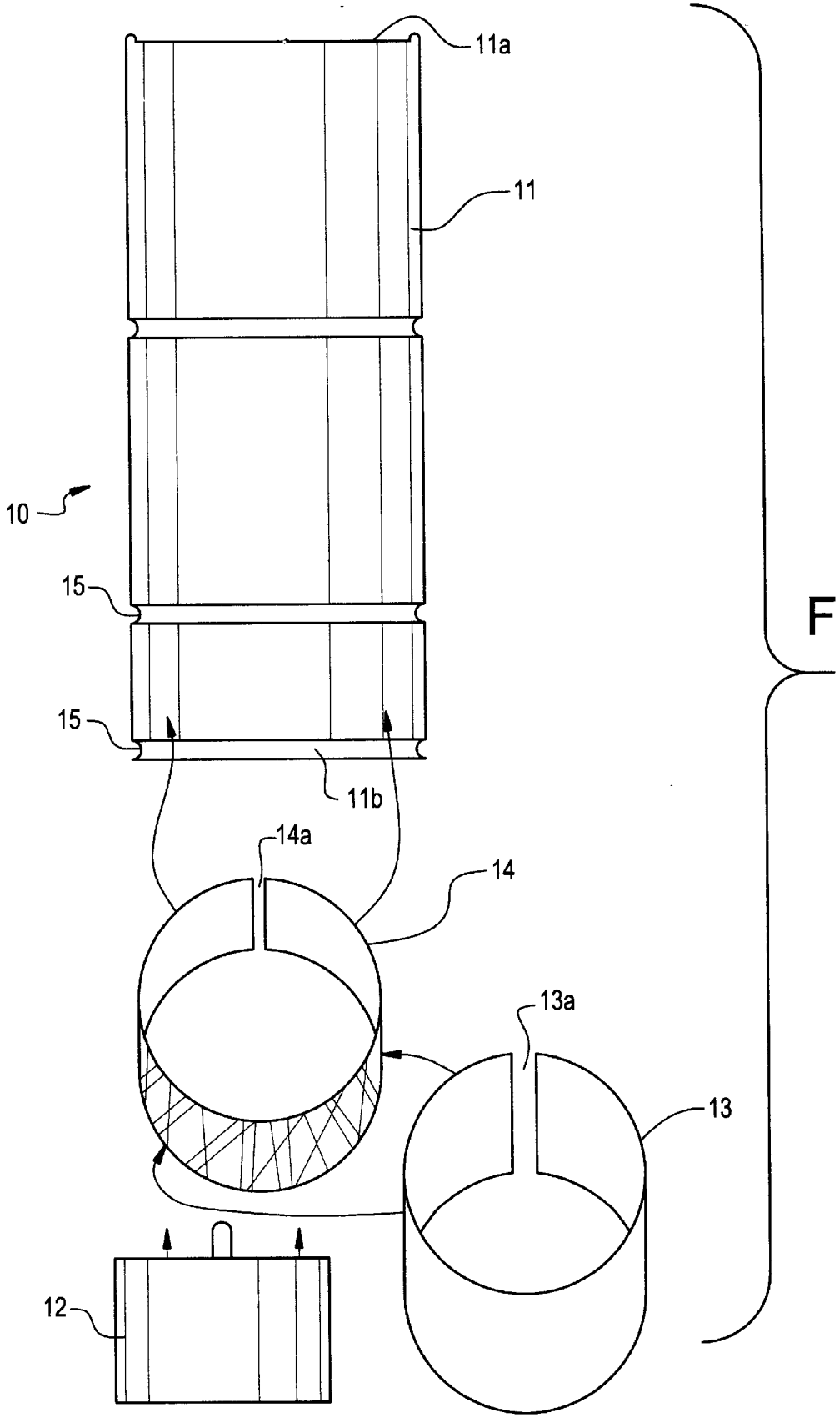

With reference to the drawing, in the single Figure, cylindrical candle emulation holder 10 is constructed with outer transparent cylindrical member 11, having a closed end 11*a* and open end 11*b*, with the latter providing access to the interior of member 11, for insertion of candle emulation electronics 12 and decorative members 13 and 14. Members 13 and 14 are shown as having cylindrical section configurations with respective longitudinal slits 13*a* and 14*a*. The slit 14*a* causes the hoop stress in the cylindrical section to gape member 14 slightly open to a diameter larger than the inner diameter of member 11 thereby resulting in a spring tension of member 14 when compressed. Member 13 is a colored film wrap (of a pre-selected color) which is fitted onto the exterior surface of etched translucent member 14. Member 13 with member 14 are radially compressed to form a continuous cylindrical section which is inserted into cylindrical member 11 and supported from lateral movement by holding indentation 15. The area of member 13 corresponds to that of member 14 and the area of cylindrical member 11 adjacent the holding indentation 15 whereby the cylindrical member 11 is selectively provided with decorative etched and colored appearances as desired.

It is understood that the above example and drawing are only exemplary of the present invention and that changes in structure and components is possible without departing from the scope of the present invention as defined in the following claims.

What is claimed is:

1. An electrically powered candle emulation device, said holder comprising a first outer, at least translucent hollow cylindrical member with at least one end wall and integrally formed, inwardly disposed holding means, the holder further comprising a second member comprising a flexible cylindrical segment of an etched plastic material with a longitudinal slit along an entire longitudinal length of the cylindrical segment, wherein the outer circumference of the cylindrical segment is slightly larger than the inside circumference of the outer cylindrical member and is of a dimension whereby it can be radially compressed to fit into the outer cylindrical member into juxtaposition with inner walls and holding means thereof for fixed positioning of the second member within the first member, the holder further comprises a third member comprising a transparent colored film member positioned between the first and second members in order to provide decorative coloring to the cylindrical holder, said device further comprising candle emulation electronics within the holder which provides the effect of a wax candle contained within an etched and colored decorative holder.

2. The device of claim 1 wherein the holding means in the first member comprises at least one integrally formed circumferential protrusion in the inner wall of the first member, wherein two protrusions and an end end wall of the first outer member are adapted to prevent vertical movement of the second and third members placed therebetween respectively.

* * * * *